US008182214B2

(12) United States Patent
Dickertmann et al.

(10) Patent No.: US 8,182,214 B2
(45) Date of Patent: May 22, 2012

(54) POND PUMP

(75) Inventors: Olaf Dickertmann, Loehne (DE); Heinz-Walter Koester, Bad Oeynhausen (DE)

(73) Assignee: Messner GmbH & Co. KG, Kalletal (DE)

( * ) Notice: Subject to any disclaimer, the term of this patent is extended or adjusted under 35 U.S.C. 154(b) by 717 days.

(21) Appl. No.: 12/307,377

(22) PCT Filed: Jun. 23, 2007

(86) PCT No.: PCT/EP2007/005550

§ 371 (c)(1),
(2), (4) Date: Jan. 5, 2009

(87) PCT Pub. No.: WO2008/003409

PCT Pub. Date: Jan. 10, 2008

(65) Prior Publication Data

US 2009/0304501 A1 Dec. 10, 2009

(30) Foreign Application Priority Data

Jul. 4, 2006 (EP) ..... 06013788

(51) Int. Cl.
*F04D 29/54* (2006.01)

(52) U.S. Cl. ..... 415/206; 415/203; 416/186 R; 416/213 R

(58) Field of Classification Search ..... 416/186 R, 416/213 R, 184; 417/349; 415/207, 213 R, 415/203, 206, 113, 230, 231, 199.2
See application file for complete search history.

(56) References Cited

U.S. PATENT DOCUMENTS

| | | | | |
|---|---|---|---|---|
| 3,867,655 | A * | 2/1975 | Stengel et al. | 310/66 |
| 4,253,798 | A * | 3/1981 | Sugiura | 415/98 |
| 5,713,719 | A | 2/1998 | Fiore et al. | |
| 7,125,224 | B2 * | 10/2006 | Raymond | 415/203 |
| 2004/0126228 | A1 | 7/2004 | Roudnev et al. | |

FOREIGN PATENT DOCUMENTS

| | | | |
|---|---|---|---|
| CN | 1580577 | A | 2/2005 |
| DE | 10064721 | C1 | 5/2002 |
| EP | 0473359 | A1 | 3/1992 |
| EP | 1441130 | A2 | 7/2004 |
| GB | 575346 | A | 2/1946 |
| WO | 9403731 | A1 | 2/1994 |
| WO | 02051658 | A2 | 7/2002 |

* cited by examiner

*Primary Examiner* — Caridad Everhart
(74) *Attorney, Agent, or Firm* — Patent Central LLC; Stephan A. Pendorf

(57) ABSTRACT

A pond pump comprising an impeller (2) which rotates about an axis of rotation (X) within a pump housing (1). The pump housing (1) comprises a suction inlet (11) that is coaxial to the impeller (2), a pressure outlet (14) for the water that is to be conducted, the pressure outlet (14) being disposed in a radial to tangential direction relative to the impeller (2), and a counterflow plate (12) between the suction inlet (11) and the pressure outlet (14). The impeller (2) is fitted with a radially disposed disk (22) with vanes (21) that are arranged on one side thereof. The counterflow plate (12) is on the impeller side encompassing the vanes (21) while channels (23) that are formed between the vanes (21) have a cross-section which tapers from the inner radial face to the outer face.

9 Claims, 2 Drawing Sheets

POND PUMP

Figure 1:
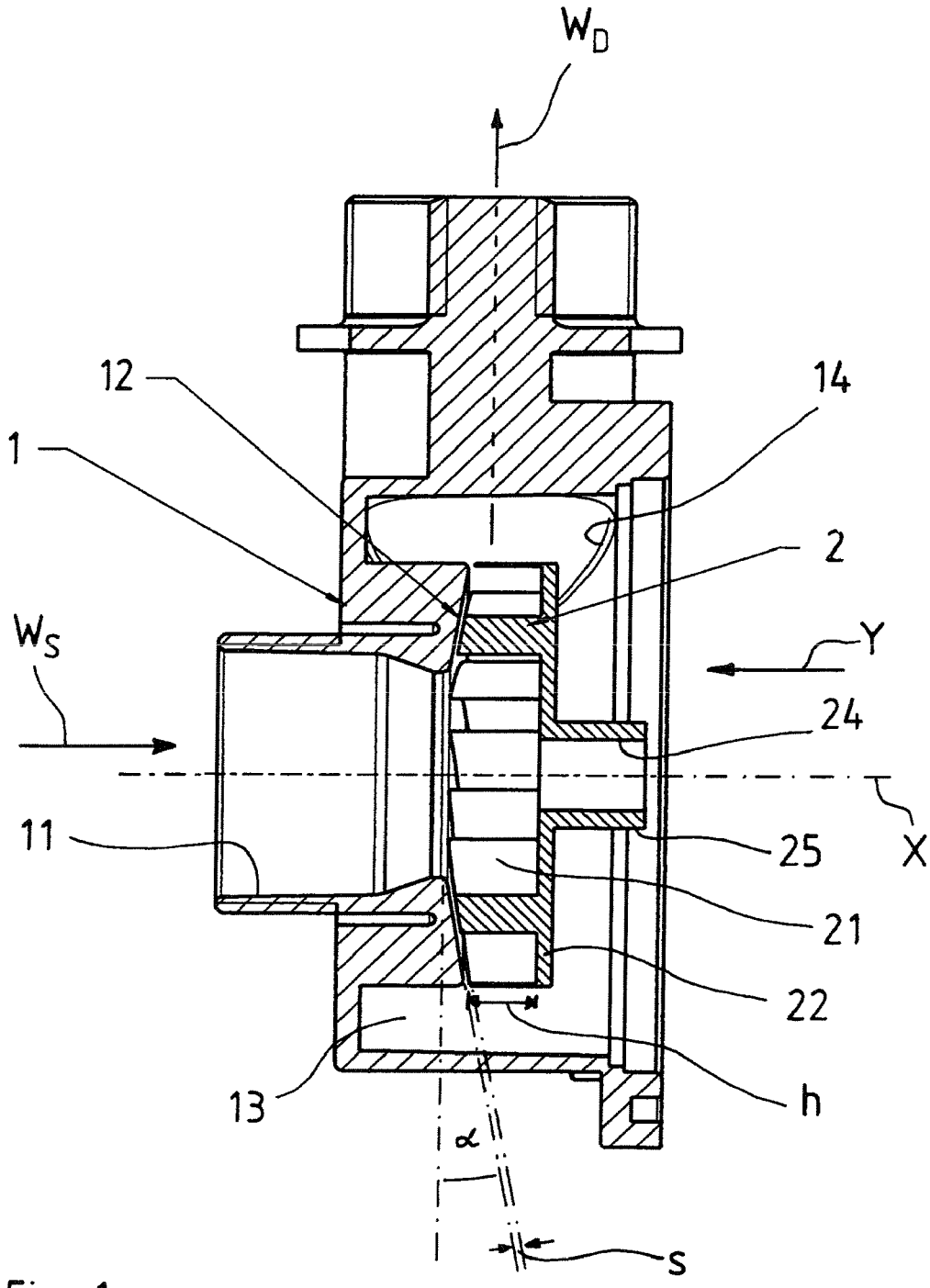

The invention relates to a pond pump comprising an impeller which rotates about an axis of rotation within a pump housing, wherein the pump housing comprises a suction inlet that is axial to the impeller, a pressure outlet for the water that is to be conveyed, said pressure outlet being disposed in a radial to tangential direction relative to the impeller, the housing further including a section between the suction inlet and pressure outlet, wherein the impeller comprises a radially disposed disk with vanes that are arranged on one side thereof, and wherein the housing segment associated with the open side of the impeller disc having the vanes is a counterflow plate surface, and wherein flow channels are formed between the vanes, the disc and the counterflow plate.

DESCRIPTION

A pump of this type is known from U.S. Pat. No. 5,713,719 as a rotary or centrifugal pump with an open impeller. The impeller includes pump wheel vanes. A flow channel is formed between the pump wheel vanes, one of the pump wheel vane carrying discs and a housing section. These flow channels expand in their cross section going from the radial inward side towards the outer side.

WO 94/03731 discloses a centrifugal pump with a non-dog impeller, in which the flow channels are defined between full pump vanes, which extend from the rotation axis of the impeller to the radial periphery, and short pump vanes, which are located at the outer ring area of the impeller. These flow channels likewise exhibit a cross-section, which increases from inwards towards outwards.

From US 2004/0126228 A1 an impeller pump with a special geometry of the spiral housing is known, in which a closed pump wheel with first and second cover discs and therein disposed flow channels is provided.

Further, centrifugal pumps are known from the general state of the art, which have a rotating impeller for conveying water. The pumps are usually employed by full emersion in the water to be conveyed (submersion pumps). Of course the suction side can also be placed in communication with the water to be conveyed via a pump conduit for suction. In the case of a dry set-up the pump must be placed next to the pond below the water level. On the pressure side the conveyed water is conveyed via a pipeline, for example, to a pond filter, a fountain, an artificial waterfall, or the like.

Centrifugal pumps operate according to a hydrodynamic conveyance principal, where the water to be conveyed is supplied in the vicinity of the rotation axis of the impeller, is taken along with the rotating impeller with its thereupon located vanes and is forced to a circular or orbital track. By the centrifugal force acting upon the water rotating in the circular track the water is radially forced outward. Accordingly, a vacuum is produced close to the rotation axis at the water intake (suction side) and an over pressure is produced at the periphery of the impeller (pressure side).

Centrifugal pumps are very reliable and, when fully encapsulated, can be electrically driven as pond pumps, for example also for swimming ponds. Further, with appropriate design of impeller and associated pump housing, water with solids can be conveyed, without having to be concerned about clogging. Therein the impeller is designed as a so-called non-dog impeller, so that the permitted solid size can be for example 6 mm (spherical passage-through).

Therewith on the suction side the flow-through amount is limited essentially by the gross or large-scale filter element with corresponding mesh width.

However, the non-dog impellers have a somewhat poorer degree of effectiveness due to circulation short-circuits and therewith internal pressure equalization in comparison to pumps with a closed impeller. Pumps with a closed impeller are, however, more susceptible to clogging, so that a correspondingly finer filter must be provided on the suction side, which provides a corresponding resistance on the free circulation.

Since pond pumps have very long life duration, and in some instance must work day and night, an improvement in the effectiveness, with a simultaneous admittance of a larger particle size, for example up to 6 mm, is desirable for an economical operation. The task of the invention is to correspondingly optimize a centrifugal pump of this general type.

The task is solved with a centrifugal pump according to claim 1. Surprisingly, it has been discovered with experiments, that a centrifugal pump with open impeller has an improved degree of effectiveness or efficiency, when the flow channels formed between the vanes have a cross-section, which diminishes in the direction of flow from the radial inner side towards the outer side. Obviously the cross-sectional narrowing of the flow channels in radial direction from the rotation axis towards the outside brings about an increase in the centrifugal flow and herewith the hydrodynamic conveyance pressure. Preferably, the degree of narrowing at the flow channel is 15% to 40%, or preferably 20% to 35%.

In the design of the above described pond pump with open impeller, the narrowing of the of the flow channel cross section can preferably be realized thereby, that the counterflow plate is in the form of a wide open conical surface segment with a angle ($\alpha$) between 5° and 20° to the plane oriented radial to the rotation axis in the direction of the impeller.

Alternatively or in addition the flow channel cross section reduction is achieved thereby, that the disc of the impeller is in the form of a wide open conical surface with a angle ($\beta$) between 5° and 20° to the plane oriented radial to the rotation axis in the direction of the counterflow plate.

Further, the degree of effectiveness of the pond pump is increased when the height of the vanes of the impeller measured axially to the rotation axis decreases from the radial inner side towards the outer side, so that the open side of the impeller is spaced apart from the counterflow plate with an essentially even gap. When the gap width is smaller than or equal to 1 mm, preferably smaller than 0.5 mm, the pressure loss by flow short-circuits between the impeller and counterflow plate are reliably prevented.

To avoid clogging in the flow channels of the impeller by solid particles, the height of the vanes at the radial outer side is larger than or equal to the width of the flow channels.

If the flow channels formed between the vanes have the same width from the radial inner side towards the outer side of the impeller, then the degree of effectiveness of the pump is further improved. Presumably, this improvement in effectiveness is attributable to a further reduction of turbulence and therewith flow losses. In addition, clogs are avoided by this design. In particular, the width of the flow channels should be larger than or equal to the maximum permissible particle size, for example larger than or equal to 6 mm.

If the vanes have a sickle shaped cross section in the plane radial to the rotation axis, then a hydro-dynamically particularly effective flow channel geometry is formed between the sickle shaped vanes. By the sickle shaped cross section the vanes exhibit a high inherent stability, so that the impeller has a long durability and lifetime.

With respect to manufacturability it is advantageous when the counterflow plate is an integral component of the pump housing. It is preferred when the pump housing and/or the impeller is produced from acrylonitrile-butadine-styrene (ABS), modified polyphenyleneoxide (PPO; so-called "Noryl") and/or polyoxymethylene/polyacetal (POM). Therein it is particularly preferred when the pump housing is produced with a one-piece integrated counterflow plate from the shape stable and economical ABS-plastic. The impeller can likewise be produced from ABS-plastic with sufficient shape stability and rigidity as an economical component or, for particularly demanding requirements, can be manufactured from PPO or POM plastic.

For good electrical efficiency with low energy consumption for the pond pump for driving the impeller an asynchronous motor with stainless steel rotor can be provided in a housing, in which a rotor is provided encapsulated in stainless steel, which together with the impeller forms a running unit removable from the housing. For a high tolerance and a long life of the pump the impeller is rotatably mounted in the housing with a ceramic bearing.

In the following an illustrative embodiment of the invention is described in greater detail on the basis of the drawings.

There shown in:

FIG. 1 an inventive pump in a sectional view through the axial plane, and

Figure 2:
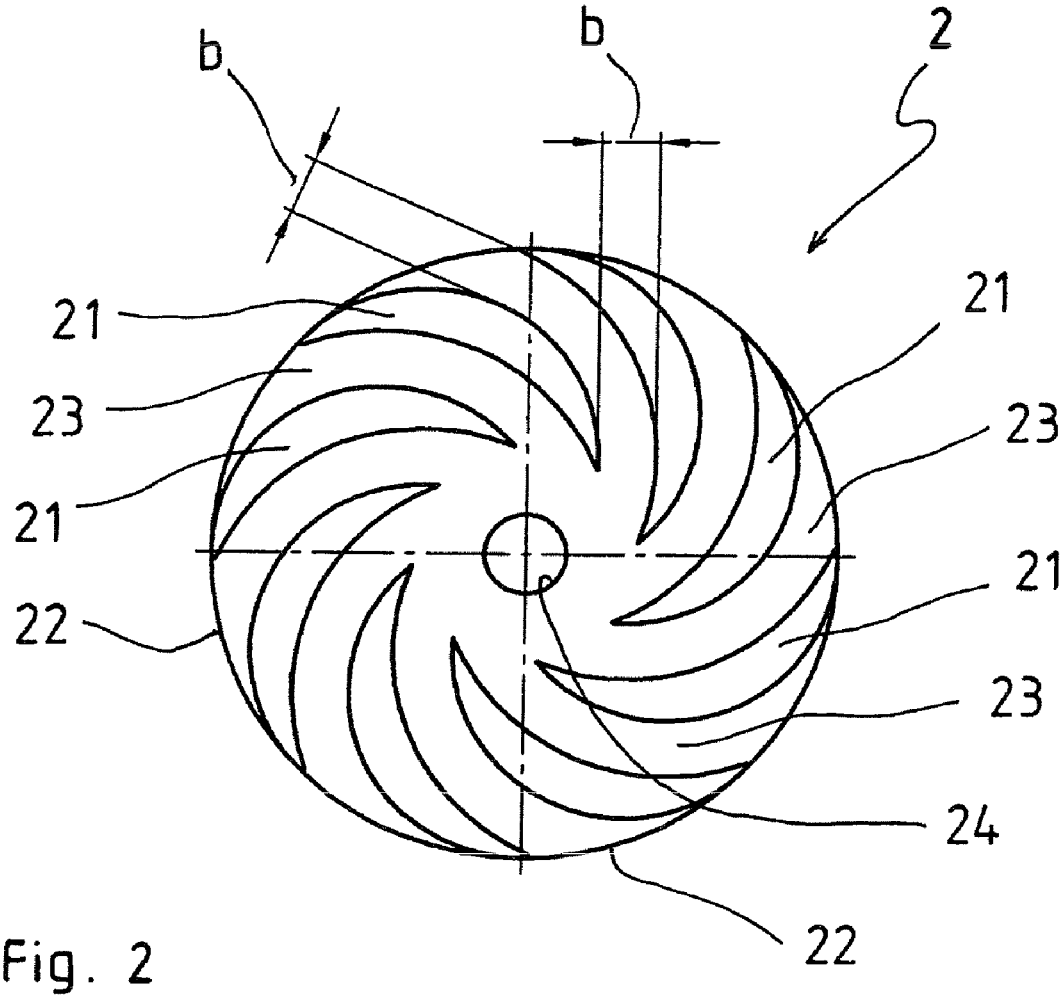

FIG. 2 the impeller shown in FIG. 1 in top view.

In FIG. 1 a sectional representation is shown through the axial plane of a pond pump with a pump housing 1 and an impeller 2 rotatable about a rotation axis X. A drive unit comprised of an electric motor provided within a housing, preferably an asynchronous motor, can be employed on the side indicated with the arrow Y. Via this electromotor rotational drive, not shown in FIG. 1, the impeller 2 is driven rotatably about the rotation axis X.

The pump housing 1 includes a suction inlet 11, which is located coaxial to the rotation axis X lying opposite to the drive side Y. On the suction inlet 11 a support is formed, upon which the suction line for supplying water to be conveyed can be seated. In the employment of the pump as pond pump the water can also be introduced directly into the suction inlet 11. The water flow on the suction side is indicated with the arrow $W_s$.

The pump housing 1 forms together with the not shown drive unit Y a surrounding housing of the rotational driven impeller 2, in order to bring about upon rotation of the impeller 2 a hydrodynamic conveyance of the water. Therein the surrounding housing of the pump housing 1 includes a ring shaped collection space or volute 13 about the periphery of the impeller 2, from which an essential tangential to the impeller 2 arranged pressure outlet 14 in the direction of the by the rotation impeller 2 on a circular path accelerated water is guided out of the pump housing in the direction of the water discharge $W_o$.

Between the suction inlet 11 arranged axial to the rotation axis X and the collection chamber or volute 13 formed in a torus shape peripheral to the impeller 2 it is provided a counterflow plate 12. The counterflow plate 12 forms an annular or circular ring shaped surface, which in the embodiment shown in FIG. 1 is a wide opened conical segment tilted with an angle α of approximately 10° to the plane in the radial direction and tilted towards the drive side Y.

The impeller 2 includes a circular disc 22 oriented in a radial plane perpendicular to the rotation axis X, upon which vanes 21 are formed projecting axially in the direction of the suction side.

In FIG. 2 the impeller 2 is shown in a top view from the direction of the suction side $W_s$ (see FIG. 1). The impeller 2 shown in FIG. 2 exhibits eight vanes 21 sickle shaped in cross section in the plane radial to the rotation axis X. Between the vanes 21 there are formed eight flow channels 23, which between adjacent vanes 21, 21 exhibit an essential constant width b of for example 6 mm. For securing the impeller upon a rotor provided with a shaft of the not shown drive unit Y a central bore 24 with associated shaft 25 is provided on the impeller 2.

As can be seen from the sectional representation in FIG. 1, the open side of the impeller 2 is located immediately opposite to the counterflow plate 12 of the pump housing 1. Accordingly, the free projecting ends of the vanes 21 are conformed or matched to the counterflow plate 12 angled at an angle α, so that between the free upper edge of the vane 21 and the counterflow plate 12 an essentially even gap width s of for example 0.5 mm is produced.

In operation of the pond pump the rotor 2 rotates about the rotation axis X. The rotor 2 is then driven by a not shown drive unit Y. On the basis of the rotational movement of the impeller 2 with the vanes 21 formed thereupon on the suction side $W_s$ water is sucked in due to the vacuum created in the center of the impeller and via the flow channels 23 is brought to the circular path. The circular acceleration of the water in the flow channels 23 results, due to the centrifugal force, in an elevation in pressure and therewith to hydrodynamic conveyance of the water to the pressure outlet 14 on the pressure side $W_D$ of the pump.

The small gap s of approximately 0.5 mm reliably prevents therein a short circuit of flow, so that the pump works particularly effectively. Likewise, the design of the flow channels 23 with an essentially constant breadth b of 6 mm allows a conveyance of water loaded with solids with a particle size of up to 6 mm through the pump without clogging. Since the height of the vanes 21 at the peripheral outlet of the flow channel 23 have at least the width b, that is, b is smaller than or equal to h, a clogging of the flow channels is avoided also with respect to the height dimensioning.

By the wide opened conical surface shape of the counterflow plate and the thereto conforming or adapted design of the height dimension of the vanes 21, the cross section of the flow channel in the flow direction from the center of the impeller 2 radially towards outwards to the peripheral exit of the flow channel in the illustrated embodiment is reduced by 24%. This cross section reduction leads surprisingly to a higher capacity of the pump.

Compared with the prior commercial generation of pond pumps of the applicant with non-dog impellers, there result the improvements shown in the following Table 1 with the products in accordance with the present invention.

Under the column "Pump type" with the reference "Messner M or as the case may be MPF . . . " the previously commercially available pump types of the applicant, and "New . . . " the respective projected next generation model is listed. As can be seen from the table, with the inventive design of impeller and associated pump housing with counterflow plate substantial improvements in the degree of effectiveness or efficiency can be achieved. On the basis of a substantially lower electrical consumption with comparable pump outputs, mainly pumping height and conveyance output or capacity, there is a striking economic advantage over the life expectancy of the pump.

TABLE 1

Comparison efficiency

| Pump type | Power Consumption | Discharge Head H max. | Displacement Q max. | Comment |
|---|---|---|---|---|
| Messner MPF 3000 | 40 W | 2.5 m | 3000 l/h | With the power consumption remaining the same, the Discharge head H has increased |
| NEW 4500 | 40 W | 2.9 m | 4680 l/h | by 0.4 m and the displacement has been increased by 1680 l/h. |
| Messner MPF 6000 | 95 W | 3.5 m | 6000 l/h | Compared to the MPF 6000, at a power consumption of 15 W less the discharge head |
| Messner MPF 8000 | 115 W | 4.0 m | 8100 l/h | is increased by 0.5 m and the displacement is increased by 156 l/h. |
| NEW 7500 | 80 W | 4.0 m | 7560 l/h | Compared to the MPF 8000, at a power consumption of 35 W less at the same discharge head a displacement of 540 l/h less is achieved, which can be considered minimal in this inspection. |
| Messner MPF 10000 | 135 W | 4.5 m | 9900 l/h | Compared to the MPF 10000, the power consumption is 31 W less; in addition the |
| NEW 10000 | 104 W | 5.2 m | 10800 l/h | discharge head has been increased by 0.7 m and the displacement has been increased by 900 l/h. |
| Messner MPF 13000 | 175 W | 5.0 m | 12600 l/h | Compared to the MPF 13000, the power consumption is 50 W less; in addition the |
| NEW 13000 | 125 W | 5.6 m | 12600 l/h | discharge head has been increased by 0.6 m. The displacement remains unchanged |
| Messner M 15000 | 285 W | 6.0 m | 1600 l/h | Compared to the M 15000, the power consumption is 100 W less; the discharge |
| NEW 16000 | 185 W | 6.0 m | 1600 l/h | head and the displacement remain unchanged. |
| Messner M 20000 | 400 W | 6.5 m | 20400 l/h | Compared to the M 200000, the power consumption is 200 W less; but has also been |
| NEW 20000 | 200 W | 5.0 m | 19000 l/h | lowered by 1.5 m and the displacement has been lowered by 1400 l/h. |

1 Pump housing
11 Suction inlet
12 Counterflow plate
13 Collection space
14 Pressure outlet
2 Impeller
21 Vanes
22 Disc
23 Flow Channel
24 Bore hole
25 Shaft
α Angle
b Width/Breadth
h Vane height
s Gap width
$W_D$ Water outflow (Pressure side)
$W_S$ Water supply (Suction side)
X Rotation axis
Y Drive side/Drive Unit

The invention claimed is:

1. A pond pump with an impeller (2) rotating about a rotation axis (X) in a pump housing (1), wherein the pump housing (1) includes a suction inlet (11) arranged axial to the impeller (2), a pressure outlet (14) for the water to be conveyed oriented radially to tangential to the impeller (2) as well as a housing segment between suction inlet (11) and pressure outlet (14), wherein the impeller (2) comprises a radially oriented circular disc (22) with vanes (21) arranged on one side thereof, wherein the housing segment associated with the vane (21) equipped open side of the impeller (2) is a surface formed as a counterflow plate (12), wherein flow channels (23) are formed between the vanes (21), the disc (22) and the counterflow plate (12), wherein the flow channels (23) have a cross-section, which decreases in the direction of flow from the radial inner side towards the outer side, wherein the counterflow plate (12) is in the form of a wide open conical surface segment with an angle (α) between 5° and 20° to the plane oriented radial to the rotation axis (X) in the direction of the impeller, wherein the height of the vanes (21) measured axial to the rotation axis (X) of the impeller (2) reduces going from the radial inner side towards the outer side, so that the open side of the impeller (2) is provided spaced apart from the counterflow plate (12) with an essentially even gap (s), and wherein the flow channels (23) formed between the vanes (21) from the radial inner side to the outer side of the impeller exhibit essentially the same breadth (b).

2. The pond pump according to claim 1, wherein the reduction of the flow channel cross section is 15% to 40%.

3. The pond pump according to claim 1, wherein the gap (s) is smaller than or equal to 1 mm.

4. The pond pump according to 1, wherein the height (h) of the vanes in the radial outer side is larger than or equal to the breadth (b) of the flow channels (23).

5. The pond pump according to claim 1, wherein the vanes (21) have a sickel-shaped cross-section in the plane radial to the rotation axis (X).

6. The pond pump according to claim 1, wherein thereby characterized, that the counterflow plate (12) is an integral component of the pump housing (1).

7. The pond pump according to claim 1, wherein the reduction of the flow channel cross section is 20% to 35%.

8. The pond pump according to claim 1, wherein the gap (s) is smaller than or equal to 0.5 mm.

9. A pond pump with an impeller (2) rotating about a rotation axis (X) in a pump housing (1), wherein the pump housing (1) includes a suction inlet (11) arranged axial to the impeller (2), a pressure outlet (14) for the water to be conveyed oriented radially to tangential to the impeller (2) as well as a housing segment between suction inlet (11) and pressure outlet (14), wherein the impeller (2) comprises a radially oriented circular disc (22) with vanes (21) arranged on one side thereof, wherein the housing segment associated with the vane (21) equipped open side of the impeller (2) is a surface formed as a counterflow plate (12), wherein flow channels (23) are formed between the vanes (21), the disc (22) and the counterflow plate (12), and wherein the flow channels (23) have a cross-section, which decreases in the direction of flow from the radial inner side towards the outer side, wherein the counterflow plate (12) is in the form of a wide open conical surface segment with an angle ($\alpha$) between 5° and 20° to the plane oriented radial to the rotation axis (X) in the direction of the impeller, wherein the height of the vanes (21) measured axial to the rotation axis (X) of the impeller (2) reduces going from the radial inner side towards the outer side, so that the open side of the impeller (2) is provided spaced apart from the counterflow plate (12) with an essentially even gap (s), wherein the flow channels (23) formed between the vanes (21) from the radial inner side to the outer side of the impeller exhibit essentially the same breadth (b), and wherein the disc (22) of the impeller (2) is shaped in the form of a wide open conical surface with an angle ($\beta$) between 5° and 20° to the plane oriented radial to the rotation axis (X), in the direction of the counterflow plate (21).

* * * * *